United States Patent [19]

Birk

[11] Patent Number: 4,838,142

[45] Date of Patent: Jun. 13, 1989

[54] REGENERATIVE ELECTRICAL IGNITER FOR A LIQUID PROPELLANT GUN

[75] Inventor: Aviezer Birk, Aberdeen, Md.

[73] Assignee: The United States of America as represented by the Secretary of the Army, Washington, D.C.

[21] Appl. No.: 183,125

[22] Filed: Apr. 19, 1988

[51] Int. Cl.[4] ..... F41F 1/04

[52] U.S. Cl. ..... 89/7; 313/137

[58] Field of Search ..... 89/7, 12, 8, 1.1; 313/137–139

[56] References Cited

U.S. PATENT DOCUMENTS

| | | | |
|---|---|---|---|
| 4,050,349 | 9/1977 | Graham | 89/7 |
| 4,085,653 | 4/1978 | Tassie et al. | 89/7 |
| 4,170,922 | 10/1979 | Peterson et al. | 89/7 |
| 4,523,508 | 6/1985 | Mayer et al. | 89/7 |
| 4,603,615 | 8/1986 | Ashley | 89/7 |
| 4,711,153 | 12/1987 | Bulman | 89/7 |

*Primary Examiner*—David H. Brown

*Attorney, Agent, or Firm*—Saul Elbaum; Thomas E. McDonald; Guy M. Miller

[57] ABSTRACT

An electrical igniter for a regenerative liquid propellant gun is disclosed which includes a combustion chamber for receiving a charge of liquid gun propellant, an electrode for igniting the liquid gun propellant, and a valve assembly for releasing the igniting propellant into a gun combustion chamber to start a regenerative combustion process therein.

6 Claims, 5 Drawing Sheets

COMPLETE COMBUSTION OF LGP AFTER SHORT DELAY (TEST GROUP C/Y)

DETAILS OF ELECTRICAL DISCHARGE OF FIG. 3 TEST

REGENERATIVE ELECTRICAL IGNITER FOR A LIQUID PROPELLANT GUN

RIGHTS OF THE GOVERNMENT

The invention described herein may be manufactured, used and licenced by or for the United States Government for Governmental purposes without payment to us of any royalty thereon.

BACKGROUND OF THE INVENTION

The present invention pertains to electrical igniters and more particularly to electrical igniters for regenerative liquid propellant guns.

The basic function of the igniter in a regenerative liquid propellant gun is to generate hot gas and discharge it into the gun combustion chamber. The igniter has to provide enough pressure and temperature in the combustion chamber to start the regenerative combustion process in the gun.

Despite recent progress toward a practical large caliber regenerative liquid propellant gun, igniter development for the gun is still in its infancy. Only solid propellant gas generators have been used effectively as igniters for the regenerative liquid propellant gun in small and medium caliber guns and are expected to perform as well in large calibers. Various igniter concepts, which are not based on solid propellants, have been suggested but none seems practical. From the logistical point of view, the ideal igniter would be based solely on the liquid gun propellant itself. However, considering the requirements for an igniter, the development of such an igniter is not an easy task. An igniter has to provide about 18 MPA pressure in the combustion chamber of the gun in about 5 milliseconds. for a large caliber gun, such as a having a 5000 cubic centimeter combustion chamber, a liquid gun propellant charge in excess of 100 grams is required.

Two basic approaches for combusting a large mass of liquid gun propellant in a short duration are plausible. In a first approach, the liquid gun propellant is ignited to combust in a bulk loaded external chamber. A vent can then be opened to discharge the gas into the combustion chamber of the gun. In the second approach, the liquid gun propellant is introduced directly into the gun chamber and is ignited there. Both approaches have drawbacks and neither has been successfully proven.

Concerning the ignition of the liquid gun propellant, it is rather straightforward in the first approach. Electrical ignition of bulk loaded liquid gun propellants have long been demonstrated. It is best accomplished by arc discharge and involves energy deposition of tens of joules which can readily be achieved. However, controlling the combustion, and the timely venting of the hot gas, strain the practicality of the approach. The risk is that the combustion may proceed too rapidly to extreme pressures resulting in the mechanical failure of the igniter. An operation with an externally loaded igniter has been recently demonstrated but it involved only 2 cubic centimeters of liquid gun propellant, LGP 1846, and a 1.6 millimeter vent orifice permanently open. Such an igniter is not practical for two reasons. First, since the liquid gun propellant is not sealed, it can leak prior to firing; and, second, large practical masses of liquid gun propellant would require much larger vents. Successful ignition to a complete combustion of bulk loaded liquid gun propellant having a large permanent vent is very difficult to achieve with reasonable electrical energy.

The second approach does not require operation at very high pressures but its practicality is also questionable. A large mass of liquid gun propellant has to be injected rapidly into the gun chamber in the form of a fine spray. This is essential, since the atmospheric pressure ignition of low loading density liquid gun propellant is very difficult. Only a fine uniformly distributed spray may be ignited, possibly by a stream of hot gas. The prompt atomization of the liquid gun propellant in the low density chamber gas environment can be practically obtained by blasting the liquid gun propellant with high velocity gas which, if hot, would also serve to ignite the liquid gun propellant. Thus, the second approach is based on the availability of auxiliary high pressure and temperature gas, which is an undesirable system complication.

SUMMARY OF THE INVENTION

Accordingly, it is an object of this invention to provide an igniter for a liquid propellant gun which uses the gun liquid propellant for gas generation.

Another object of the invention is to produce an igniter which requires a modest amount of electric energy and is independent of the liquid gun propellant mass to be ignited.

Yes another object of the invention is to construct an igniter which is sealed prior to firing which doesn't leak regardless of its orientation in a gun.

Still another object of the invention is to control the gas generation rate of an igniter to insure reliability.

Another object of the invention is to provide an igniter which is scalable to large caliber regenerative liquid propellant gun.

The present invention is summarized in an electrical igniter including a body means, an interior cavity in the body means for receiving a charge to be ignited, inlet port means in the body means communicating with the interior cavity, outlet port means in the body means communicating the interior cavity, means for closing the inlet port means, electrode means at the interior cavity for igniting a charge therein, and valve means for opening and closing said outlet port means, the valve means and outlet port means being configured to allow a discrete discharge of hot combustible gas and a discrete discharge of the liquid charge such that the discharging liquid charge is combusted by the hot combustible gas.

Further objects and advantages of the present invention will become apparent from the following description of the preferred embodiment when taken in conjunction with the accompanying drawings.

DESCRIPTION OF THE PREFERRED EMBODIMENTS

Figure 1:
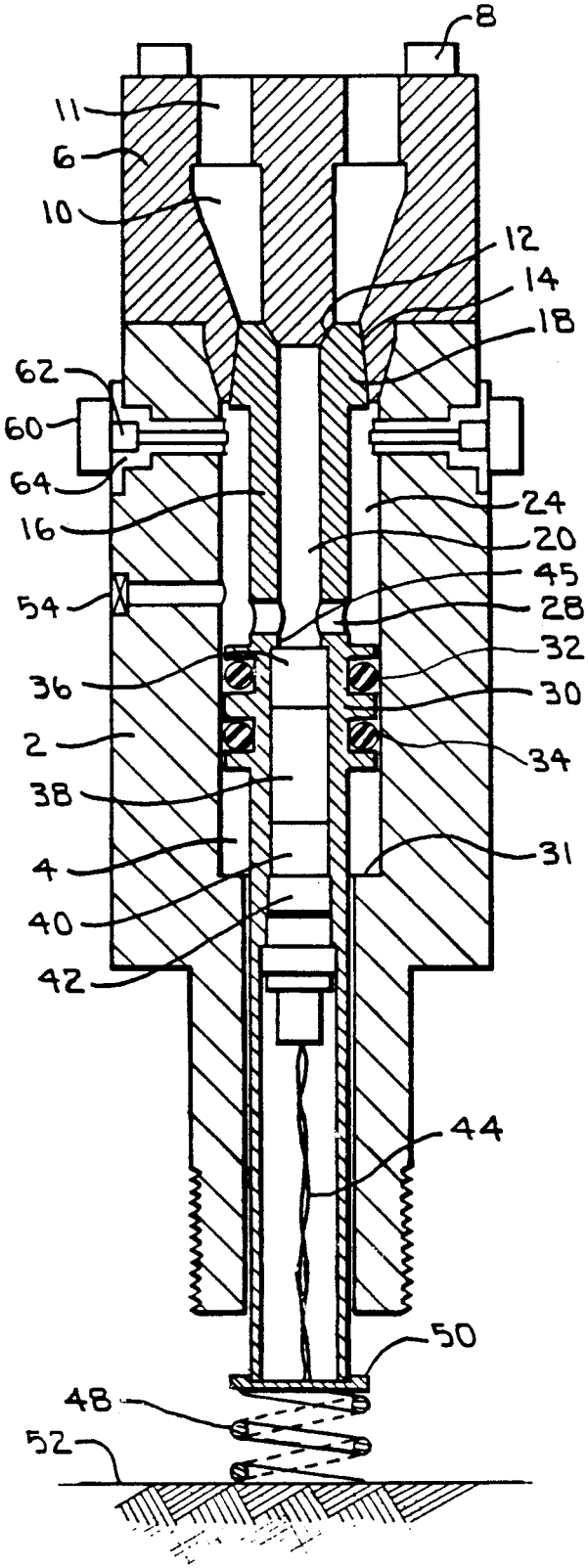
FIG. 1 is a side elevation view in cross section of an igniter embodying the present invention.
Figure 2:
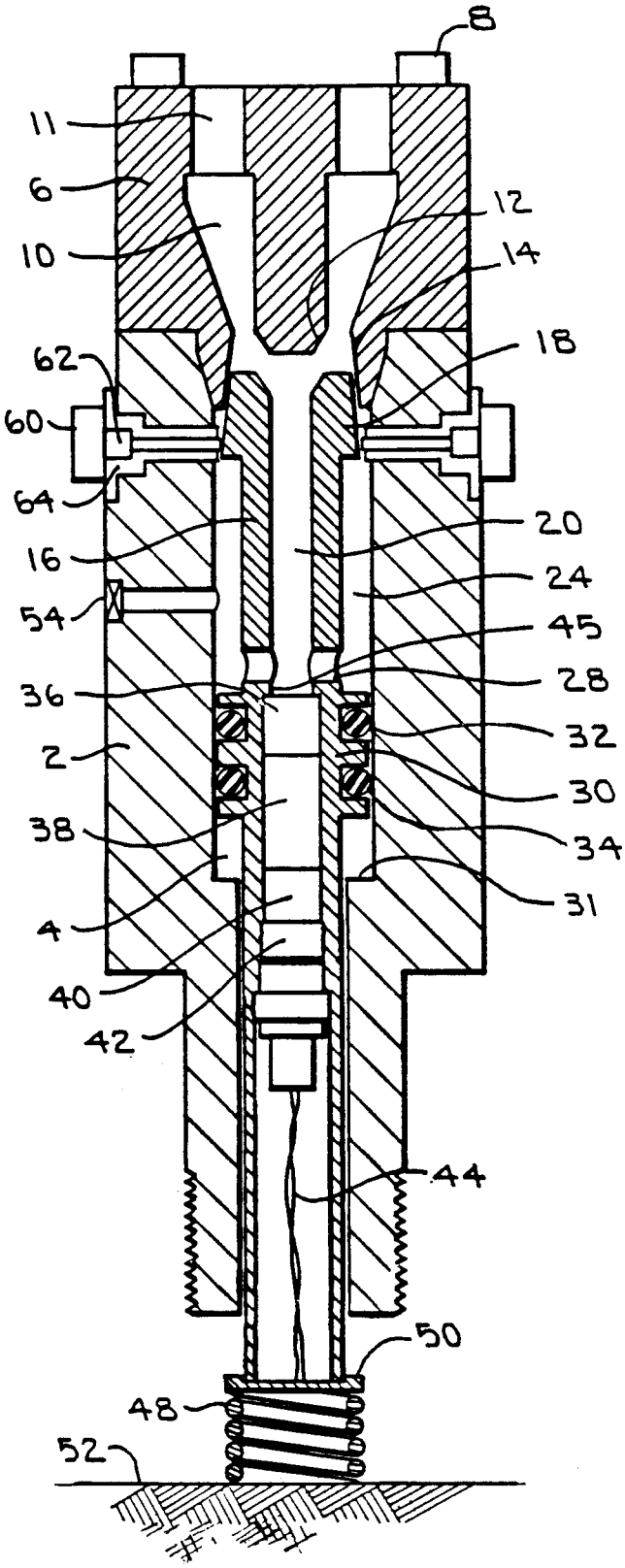
FIG. 2 is a side elevation view of the igniter of FIG. 1 during combustion.

Referring to the drawings, an igniter in accordance with the present invention is shown in FIGS. 1 and 2 and includes a cylindrical body 2 having an annular cavity 4 extending longitudinally therethrough. A head 6 is affixed to body 2 by a plurality of bolts 8. Head 6 includes a plurality of inner chambers 10 and vanes 11 extending therethrough into communication with the annular cavity 4 of body 2 which are contoured to form conical valve seats 12, 14 at the interface with annular cavity 4.

A slideable valve 16 having a cylindrical configuration is disposed for longitudinal movement within cavity 4. Valve 16 includes a valve head 18 contoured for mating engagement with the surfaces of conical valve seats 12 and 14. Normally, these valve seats 12, 14 are lapped into contact but may alternatively carry primary or secondary sealing elements such as "O" rings (not shown). The slideable valve 16, which has an elongate stem valve configuration, is hollow to define a centrally disposed inner cavity 20 and is externally configured to define a circumferentially disposed cavity 24 interconnected to inner cavity 20 by a plurality of radially arrayed ports 28. The cylindrical body 2, head 6 and slideable valve 16 are made of any of numerous metals or metal alloys capable of withstanding the pressure and temperature of a combustion process.

Slideable valve 16 includes a valve body 30 having circumferential recesses therein for accommodating "O" rings 32, 34 therein in conventional manner which seal the lower end of the interconnected cavities 20, 24. Valve body 30 is prevented from retracting beyond a shoulder 31 in body 2. Valve body 30 includes a pressure measurement system including a floating piston 36 and packing medium 38, such as grease, and a pressure transducer 40 retained therein by a threaded seal ring 42. Pressure transducer 40 includes electrical leads 44 for obtaining an electrical signal indicative of pressure. The floating piston 36 is in direct communication with inner cavity 20 through an internal port 45. A spring 48 abuttably bears on valve body 30 through an intermediary washer 50 and is restrained against an immobile surface 52, which may be a part of the gun or gun support system. Spring 48 acts to keep valve 16 in a normally closed position in mating engagement with valve seats 12, 14 such as shown in FIG. 1.

Figure 3:
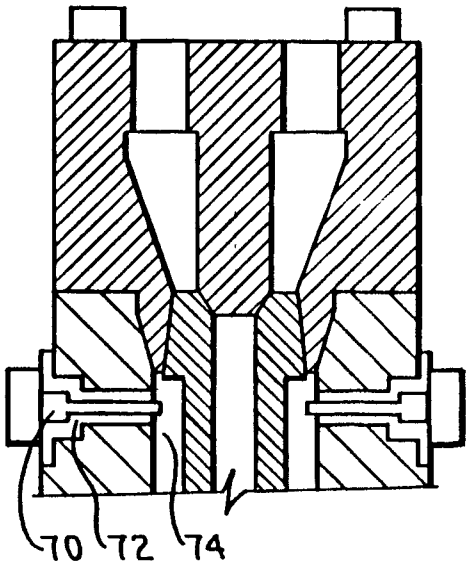
FIG. 3 is a side elevation view in cross section of a portion of the igniter of FIG. 1 showing an electrode configuration used therein.
Figure 4:
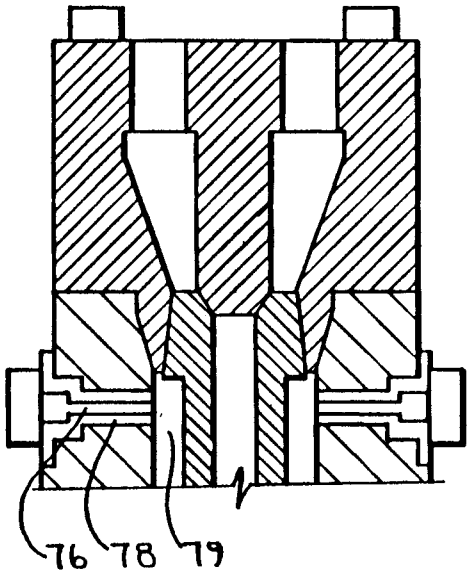
FIG. 4 is a side elevation view in cross section of a portion of the igniter of FIG. 1 showing another electrode configuration used therein.
Figure 5:
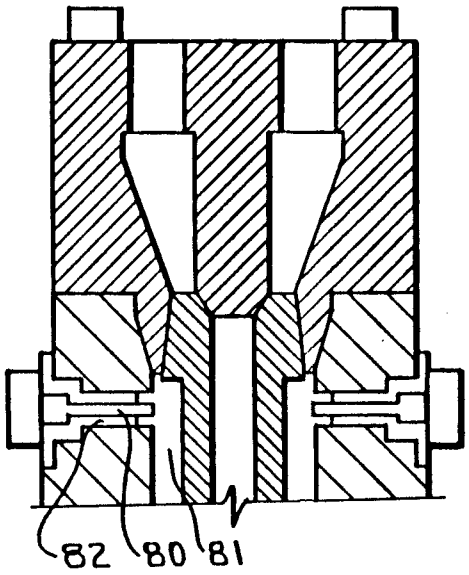
FIG. 5 is a side elevation view in cross section of a portion of the igniter of FIG. 1 showing still another electrode configuration used therein.

A valve controlled charging port 54 is disposed in body 2 to enable the ingress of a charge of liquid propellant into the chamber defined by interior cavity 20, cavity 24 and ports 28. An igniter electrode assembly, such as any of those shown in FIGS. 3, 4 and 5, is disposed in body 2 and includes an electrode ring 60 in electrical contact with a plurality of radially disposed electrode pins 62. A suitable insulation 64, such as a high strength ceramic material, provides suitable electrical isolation of the electrode ring 60 and electrode pins 62 from body 2. The electrode pins 62 are purposely positional close to valve seat 14 for the purpose of controlling the generation of discrete discharges of combustible gas through valve seat 14 and liquid propellant through valve seat 12 during the opening of valve 16, which will be discussed further in the description of the operation of the igniter which is to follow.

The igniter electrode assembly of FIG. 3 includes cylindrical electrode pins 70 surrounded by insulation 72. The insulation extends to a point flush with the edge of cavity 74 and the electrode pins extend into cavity 74. In FIG. 4, the igniter electrode assembly includes electrode pins 76 surrounded by insulation 78 which both extend to a point flush with the wall of cavity 79. In FIG. 5. The igniter electrode assembly includes electrode pins 80 which extent to a point flush with the wall of cavity 81 and insulation 82 surrounding the electrode pins 80. Insulation 82 terminates prior to reaching the end of the electrode pins 80 thereby allowing the ends to be exposed.

The igniter embodiments disclosed herein were constructed to include the floating piston assembly for test and experiment purposes. For a practical igniter for the field the push rod portion of the valve body 30 would be unnecessary and the floating piston assembly therein would simply be replaced by a sealing plug. Spring 48 will be repositioned to sit on shoulder 31 to exert upward pressure directly on the underside of valve body 30. Also, the electrode pins 62 should be suitably insulated, such as by a high strength ceramic material.

Figure 6:
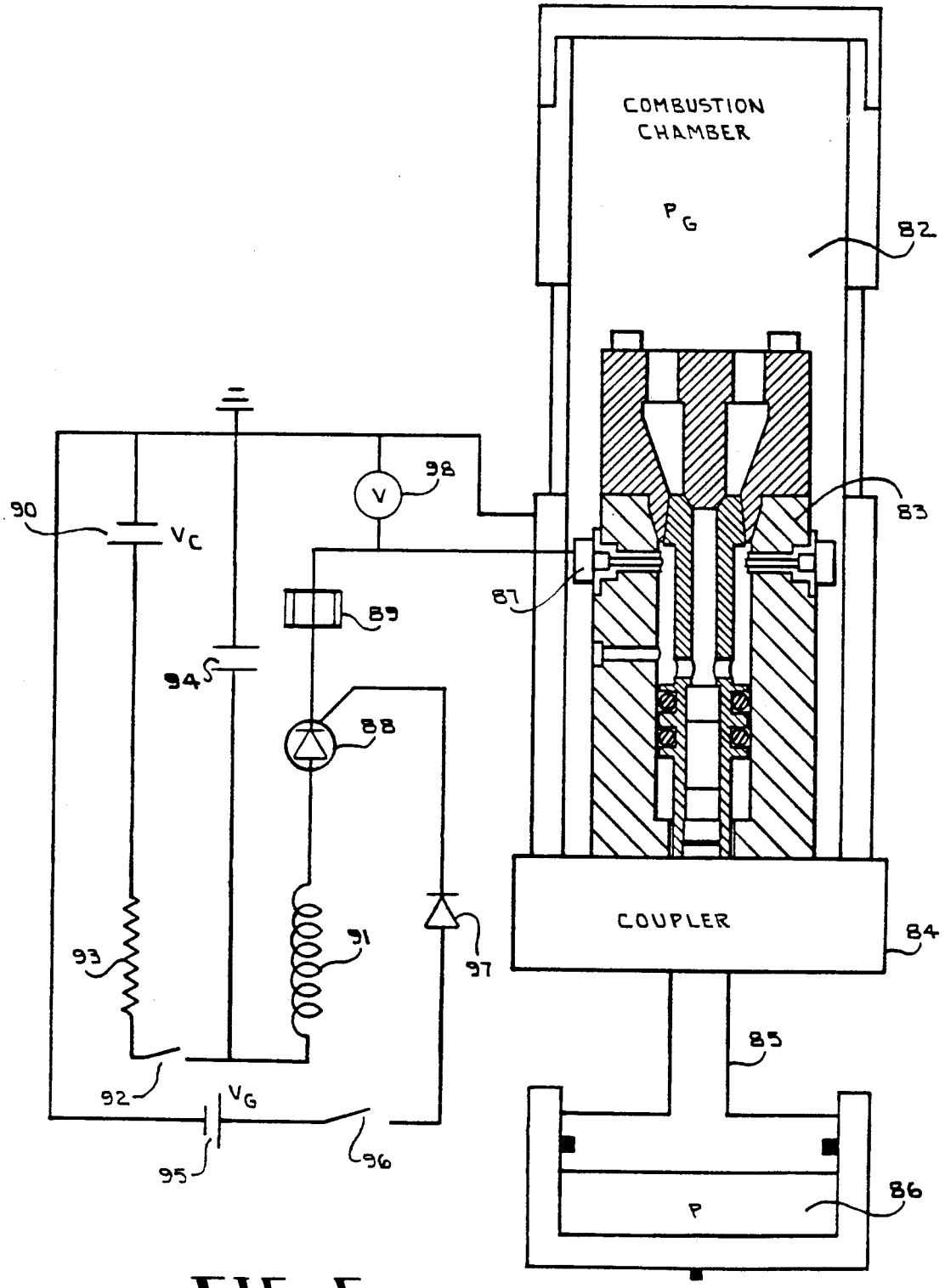
FIG. 6 is a testing system for simulating the operation of an igniter with a gun.

As shown in FIG. 6, a system for testing igniters by simulating operation with a gun includes a closed combustion chamber 82 having an igniter 83 to be tested therein which is securely mounted to a suitable coupler 84. The coupler 84 firmly retains the body of igniter 83 while allowing the valve and piston assembly of igniter 83 to move in their intended manner. A differential area push rod 85 is affixed to the valve of igniter 83 and in conjunction with associated pressure chamber 86 applies suitable force to keep the valve closed prior to ignition. The pressure in pressure chamber 86 is selected such that a pressure thirteen times greater than that of pressure chamber 86 is required to unseat the igniter valve.

An electrical discharge circuit for producing an electrical arc at the igniter electrodes to initiate combustion of the liquid gun propellant includes a silicon controller rectifier 88 having its cathode connected to electrode ring 87 through a current measuring instrument 89 and its anode serially connected to the positive side of a direct current main voltage source 90 through an inductor 91, a switch 92 and a resistor 93. The negative side of voltage source 90 is grounded, as are the combustion chamber 82, coupler 84 and the body of igniter 83. A capacitor 94 is connected between one side of inductance 91 and ground. A gate control circuit for the silicon controlled rectifier includes a voltage source 95 having its negative side connected to ground and its positive side serially connected to a switch 96 and a rectifier 97 having its cathode connected to the gate of the silicon controlled rectifier. A voltmeter 98 is connected between the ignite electrode ring 87 and ground.

In the operation of the igniter, FIG. 1 shows the igniter in the "ready" mode. The initiator liquid propellant charge is introduced into the chamber formed by interconnected cavities 20, 24 via check valved charging port 54 which is then closed. This chamber is sealed circumferentially by the interior wall segment of the igniter body 2 and the corresponding wall and "O" ring assembly of valve body 30 and at the upper end thereof by conical valve seal 12 and 14 in metal/metal contact with mating surfaces in valve head 18.

A suitable voltage applied to the electrode ring 60 causes the passage of electrical current therethrough to electrode pins 62 which generate an arc through the liquid propellant, to valve 16 and/or to body 2, and then to ground. Passage of current through the liquid propellant initiates combustion thereof which generates a combusted gas in the upper end of the cavity 24 proximate electrode pins 62 producing pressure which is transmitted hydraulically to act upon the "O" ring containment area of valve body 30.

As shown in FIG. 2, as combustion continues, it produces a force which activates slideable valve 16 to compress spring 48, thus opening annular flow passages at the faces of conical valve seats 12 and 14. The combusted gas at the upper part of cavity 24 acts to force the liquid propellant to move to the lower part of cavity 24, through ports 28 into interior cavity 20 as the liquid propellant initially in interior cavity 20 passes into the inner chambers 10 of head 6 over valve seat 12. As substantially all of the liquid propellant moves across valve seat 12, the hot combustion gas emerges across valve seat 14 into inner chamber 10 while entraining and combusting the ejecting liquid propellant in the inner chamber 10, the mixture achieving homogeneity before passing to the main chamber of the gun (not shown) through vanes 11 to ignite the liquid gun propellant in the main chamber to thereby fire the gun. Upon completion of combustion in the gun, the pressure in the main gun chamber and the igniter cavity 20,24 abates to thereby allow slideable valve 16 to retract to a closed positions for the next ignition cycle.

Igniters are generally disclosed were constructed for test purposes to include the three electrode configurations in FIGS. 3 through 5 and were tested utilizing the operation simulation system of FIG. 6. Being exploratory in nature, the igniters were rudimentarily constructed to fit into existing hardware. Each igniter included three major parts: the igniter body (part 1), the igniter stem valve and piston assembly (part 2), and the head or combustion sub-chamber (part 3). Liquid gun propellant was sealed between the first two parts avoiding any ullage. The stem valve contained six venting nozzles for the combustion sub-chamber. Four pin electrodes having a 1/16 inch diameter were provided to ignite the liquid gun propellant close to the combustion gas ejection valve seat. The pin electrodes were insulated and held in place by epoxy moldings. A power distribution ring provided electrical continuity between the electrodes. Part 2 contained a Kistler 601B pressure transducer to measure the liquid gun propellant pressure via a teflon floating piston and a grease column. The differential area push-rod 85 applied force on part 2 to hold it tight against parts 1 and 3. A pressure 13 times greater than the holding pressure of the push-rod was required in order to unseat part 2.

The electrical discharge circuit of FIG. 6 is basically an LRC circuit. The capacitor 94 was charged by voltage source 90 to 500 volts and discharged by the activation of the silicon controlled rectifier 88. The activation was by the remote closure of switch 96 which applied 5 volts from voltage source 95 to the gate of silicon controlled rectifier 88. The voltage applied to the electrodes and the current flow therethrough were monitored by voltmeter 98 and current measuring instrument 89. The current was measured using a Pearson Electronics Pulse Current Transformer model 3025. The circuit was underdamped (i.e., oscillatory decaying) since the liquid gun propellant ofered little resistance during arcing. Inherently, the silicon controlled rectifier 88 passed only half cycles.

The exposure lengths of the electrode pins in FIGS. 3 and 5 was 1/16" which was equal to their diameter. The FIG. 5 embodiment is effective due to the steep electrical field perpendicular to the curved surfaces of the electrode pins between the edges of the electrode pins and the adjacent stepped walls. The FIG. 3 embodiment is more effective than that of FIG. 4 due to the shorter discharge distance. On the other hand the FIG. 3 and 5 embodiments are more prone than the FIG. 4 embodiment to erosion. Also, the FIG. 5 embodiment is more prone to electrode shielding by large gas bubbles around the pins during liquid gun propellant loading which may impede arcing.

The prnciple of operation is as follows. The sealed liquid gun propellant is ignited by arc discharge using the electrical circuit of FIG. 6. Gaseous products are generated and the pressure rises to overcome the push-rod force. The igniter piston & valve (part 2) then retreats and an annular vent at the gas ejecting valve seat opens to vent the gas into the combustion sub-chamber (part 3). Coincidently, a vent is opened along the liquid gun propellant ejecting valve seat to inject the liquid gun propellant into part 3. The liquid injection is due to the gas products pressure transmitted hydraulically throughout the liquid gun propellant via the connecting passages in part 2. The hot high velocity combustion products promptly mix with the injected liquid gun propellant to finely atomize the liquid and ignite it. Fine atomization is achieved by the impingement, and shearing action on the liquid, of the high velocity gas. Sonic pressure waves emanating from the vent exit aid in the atomization process. Ignition occurs because of the promptness and fineness of the mixing between the hot gas and the liquid. The resulting homogeneous two phase mixture has a rather uniform temperature distribution in accordance with the mass flow rates of the separate phases and their temperatures. Even if the gas mass flow rate is only one tenth of the liquid flow rate, due to the high temperature of the gas (over 2000 degrees kelvin), the final mixture will attain a temperature above 200 degrees centigrade which is enough for initiation of propellant decomposition. Transition to combustion follows after the pressure has arisen above 5 MPa. Mechanisms of gas/liquid mixing and their flow rates are discussed next.

The gas and liquid are injected separately. The gas is injected through a converting annular nozzle to reach sonic velocity at its next. The mass flow rates dependence of $P_L$ can be roughly estimated as follows: Assuming that the gas does not contain liquid particles, the gas mass flow rate ($m_G$) per arear ($A_G$) is found using choked flow relations. For a specific liquid gun propellant, LGP 1846, one gets:

$$m_G/A_G[\text{kg/sec cm}^2] = 8.05\ P_L[\text{MPa}]$$

(where the constant 8.05 has the proper dimension)

The liquid flow obeys the Bernoulli equation, and for an LGP 1846, assuming a typical discharge coefficient of 0.7, one gets for the liquid mass flow rate ($m_L$) per unit area ($A_L$):

$$m_L/A_L\ [\text{kg/sec cm}^2] = 155.8\ P^{\frac{1}{2}}[\text{MPa}]$$

From the above expressions, it is apparent that although the gas flow rate rises faster with pressure than the liquid flow rate, only at $P_L=374$ MPa (for $A_G=A_L$ and neglecting compressibility and non-ideal flow effects) equal mass flow rates would be achieved. At the lower pressures, the liquid mass flow rate per unit area greatly exceeds that of the gas, but, as explained before, ignition of the entire liquid is still possible due the prompt fine mixing of the phases. This is the key to the ability of the igniter to consume rapidly large masses of liquid gun propellant at moderate pressures and vent openings.

The geometrics of the sealing surfaces of the igniter tested in this work were such that $A_L=2.32\times[cm^2]$ and $A_G=1.68\times[cm^2]$, where X is the part 2 displacement upon vent opening (for X 0.1 cm). The igniter would inject 4.5 cc of LGP 1846 in 5 msec under $P_L=18$ MPa when X=0.76 mm. The calculated ratio of liquid to gas mass flow rates at $P_L=18$ MPa was about 6.3 which was enough to assure ignition. Thus, in principle, the igniter should have been capable of discharging its contents and ignite them in less than 5 msec.

An unknown factor in the design of the igniter was the combustion rate of the liquid gun propellant in its reservoir. As discussed before, for a successful operation of the igniter, the gas generation had to be no less than a tenth of the injected liquid mass flow rate. This required less regression rates (due to gas generation) higher than 50 cm/sec. The only published data available concerning regression rates were obtained with a gelled LGP 1845 in an open tube. The data indicated weak dependence on pressure (to the 0.103 power for pressures below 60 MPa) and regression rates an order of magnitude lower than igniter geometry and operating conditions. Therefore, the geometry and dimensions of the igniter vent openings were designed intuitively. It was hoped that $P_L$ could be stabilized below 30 MPa as the igniter could not (for practical reasons) be constructed robust enough.

Figure 7:
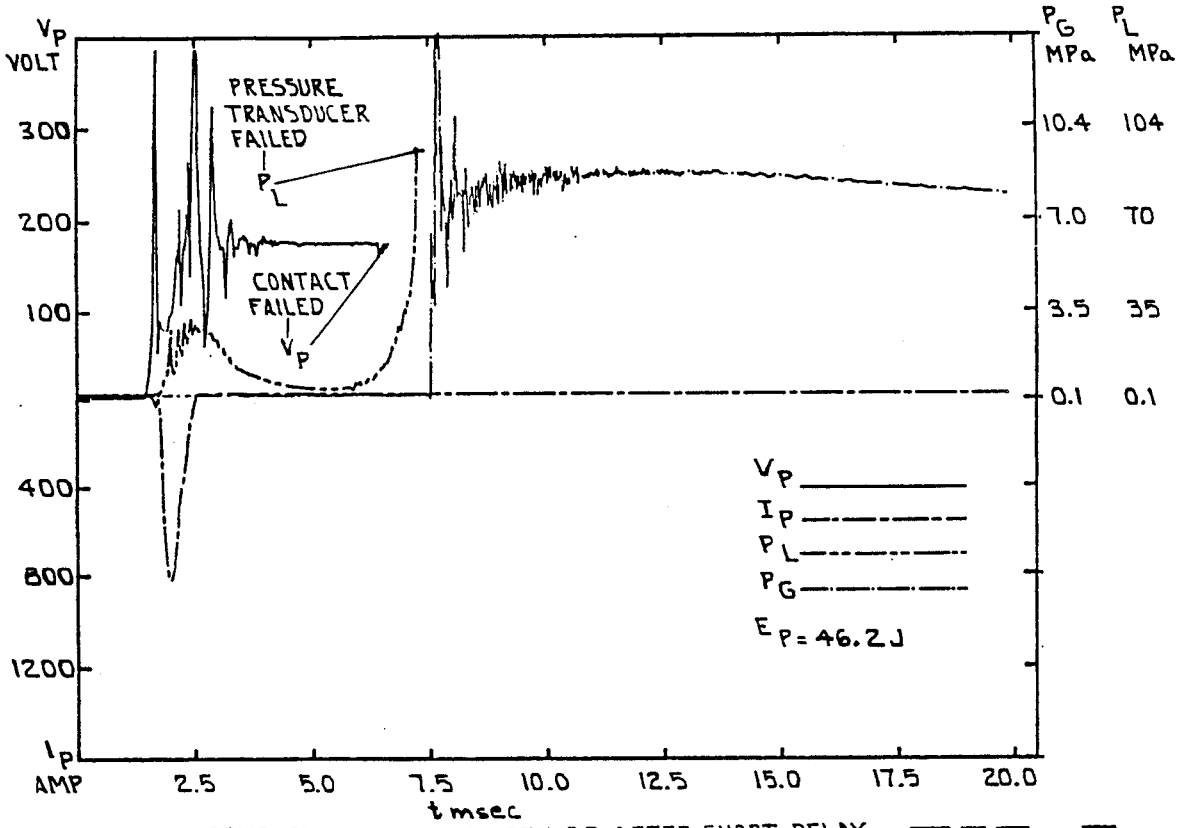
FIG. 7 is a graph showing results of tests employing the system of FIG. 6.
Figure 8:
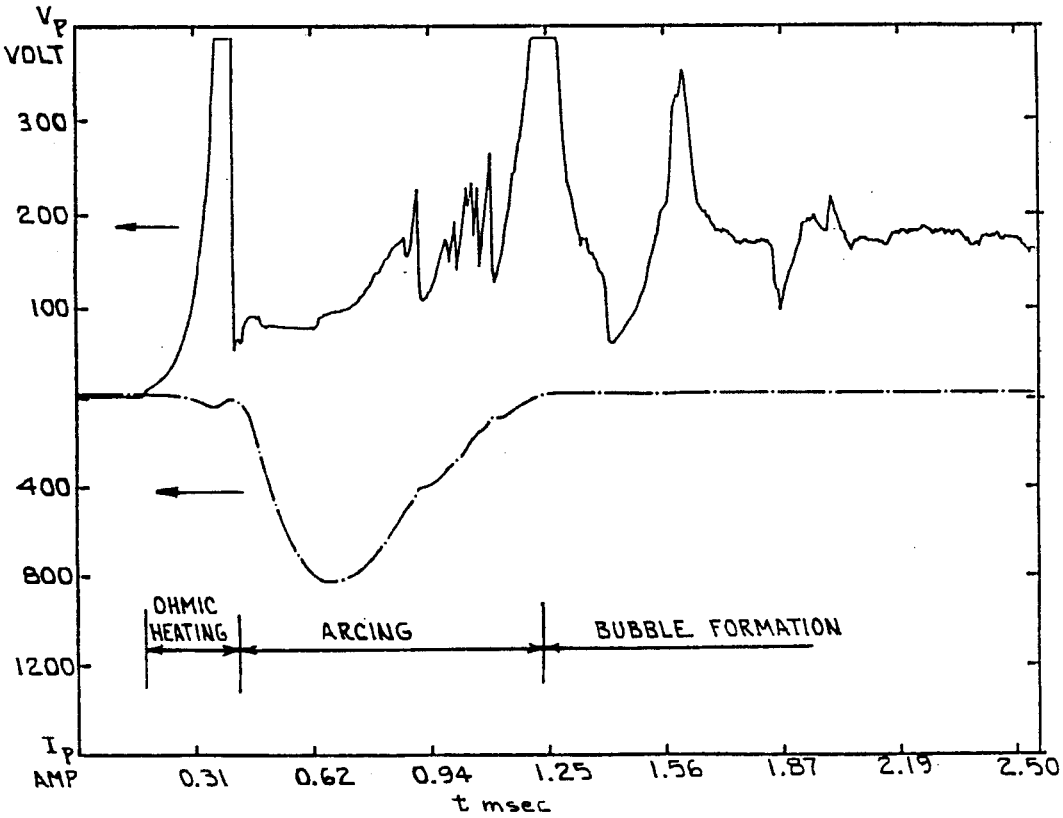
FIG. 8 is a graph showing a portion of the graph of FIG. 7 in greater detail.

The summary of successful tests with igniter opening pressures above 18 MPa is given in the table below. The tests with the best recorded data are depicted in FIGS. 7 and 8. The data was recorded on a Nicolet 4094 wave recorder. The table represents only a third of the test actually conducted. A number of tests yielded erratic results which were traced (based on current and voltage measurements) to bad contacts in the electrical circuit. In other tests, with opening pressures below 18 MPa or when voltages were too low, ignition never occured. The main parts of the igniter had to be refabricated twice as two tests resulted in catastrophic failure of the igniters. The test results are set forth below.

| Test** Group | No. of Tests | LGP Main Voltage | Results |
|---|---|---|---|
| A/N | 4 | 1846 | 300 | Prompt*** ignition and complete combustion of LGP. The igniter was destroyed in the last test. |
| B/Y | 4 | 1846 | 400 | Two prompt ignitions and one delayed ignition but incomplete combustion. Delayed ignition in last test followed by complete combustion and destruction of the igniter. In the last test, the opening pressure of the igniter was set at 27 MPa. |
| C/Y | 2 | 1846 | 400 | Prompt ignition in the first test but incomplete combustion. In the second test, prompt ignition and slightly delayed complete combustion (FIG. A-3). The combustion sub-chamber of the igniter was damaged. |

*Opening pressure of the igniter was set to 18 MPa.
**Electrode configuration / Y for igniter injecting into combustion chamber. N for injection into open air.
***Less than 5 msec delay.

Tests were performed involving the igniter injecting into open air. The original igniter was fabricated from stainless steel 316 to prevent corrosion. Only the igniter piston was made from stainless steel 17-4PH which is much harder than the 316. This prevented galling and locking of the sealing surfaces upon impact as the vents reclosed under pressure after the LGP exhaustion. The combustion sub-chamber was screwed onto the igniter body and a rubber o-ring seal was placed between them. In the first test group (A/N), the concept with configuration A proved its effectiveness in achieving prompt ignition and combustion of the LGP. The ignition was manifested by a loud sound, by a sudden rise in $P_L$, and by the ejection of fluid from the igniter. No traces of liquid were found after the test inside the igniter and on witness plates outside, which was an indication of complete combustion (exclusively to gaseous products). In the last test, the igniter's sub-chamber and body were sheared apart violently due to failure of the threads and bulging of both parts. The bulging indicated yielding of the material reservoir and in the combustion sub-chamber. Such high pressures occured in later tests, a clear indication of tremendous LGP regression in the reservoir. It is possible that the liquid surface was highly agitated resulting in a much increased surface area.

New igniter parts were fabricated in order to continue with the B/Y test group. The parts were made from the much stronger stainless steel 17-4PH. Although prompt ignition and LGP injection was obtained, the combustion was incomplete as evidenced from the post test recovery of most of the LGP.

To simulate operation in a gun, the next series of tests was conducted with the igniter mounted in the combustion chamber (FIG. 6). The degree of liquid gun propellant combustion was judged from the pressure level $P_G$ obtained in the combustion chamber.

In the test group discussed before (FIG. 3 electrode configuration), the igniter piston material across the electrode gas was found eroded. It was suspected that the spalled hot metal fragments aided in the ignition. Therefore, the electrode configuration of FIG. 4 was chosen for the next test group (B/Y). This configuration was found less effective than the FIG. 3 configuration and the voltage had to be raised to 400 V. The test results were peculiar. Although the arc discharges were nominal, the ignitions were delayed for over a second in two tests. In an attempt to achieve prompt igition and complete combustion, in the last test the opening pressure of the igniter was increased to 27 MPa. Although complete combustion was achieved, the ignition was delayed by almost a second as in a previous case, the igniter threads failed, resulting in the abrupt separation of the igniter sub-chamber from its body, albeit without bulging of the parts. Apparently, liquid gun propellant was trapped in the threads and ignited there causing concentrated thermal stresses. (the 17-4PH material is notorious for failure under high thermal stresses.) New igniter parts were fabricated from 17-4PH but this time the sub-chamber was bolted to the igniter body. This construction proved more durable.

Trying to achieve better results, the electrode configuration of FIG. 5 was used in the remaining tests. For this configuration, the tests were more successful than the FIG. 4 configuration tests, and electrode erosion was far lower as compared to the FIG. 3 configuration.

In the second test of group C/Y, complete combustion was obtained within approximately 5 msec from arc discharge. The combustion in the sub-chamber was so intense that the LGP stem valve shattered.

The last test is depicted in FIG. 7 and 8 which reveal many aspects of the operation and performance of the igniters. The voltage and current measurements revealed the dynamics of the arcing and the amount of electrical energy actually deposited in the liquid gun propellant. The liquid pressure measurements indicated the outcome of the electrical discharge. A pressure ($P_L$) above 18 MPa indicated the ignition of the liquid gun propellant, and the opening of the igniter and ejection of fluid. A steep rise of $P_L$ to values well above 18 MPa indicated runaway combustion within the igniter. A measurable gas pressure ($P_G$) in the large combustion chamber indicated significant combustion of the liquid gun propellant. The interpretations of the various measurements are discussed next.

ELECTRICAL DISCHARGE IN THE LGP AND IGNITION

In the present work, the electrode pins were used as the anodes and the chamber walls as the cathode. The first millisecond of the electrical discharge exhibited the same characteristics in all of the tests. The details are shown in FIG. 8. In the first stage of the electrical discharge no arcing occurs but ohmic heating of the liquid occurs. The voltage across the electrode gap ($V_P$) will rise to a value that is commensurate with the circuit inductance and LGP conductance with a corresponding increase in current. Local vaporization may commence at the electrode minimum-area surface and in be generated near the surface by electrolysis. The electrical field near the electrode surface will be altered by both ion migration and the generation of tiny gas bubbles. Eventually, a local breakdown of the field takes place followed by arcing and the formation of a continuous plasma channel across the electrodes gap. Associated with the arcing is a rapidly dissipating shockwave in the liquid. Thermal and chemical (Due to radicals in the plasma) ignition of the LGP may ensue, with further gas generation, leading to pressure rise and reaction propagation.

The duration and strength of the arcing depend on the electrical circuit capacitance and inductance. The initial arc may not discharge all of the circuit energy and a second arcing, albeit much weaker, is possible. The electrical energy deposited in the liquid gun propellant ($E_P$) is simply the product $V_P I_P t$. Typically, less than 50 joules were sufficient for ignition (FIG. 7).

COMBUSTON CHAMBER PRESSURES AND FLOW PHENOMENA

The theoretical adiabatic equilibrium pressure in the 500 cc combustion chamber upon the complete combustion of the igniter's LGP (4.5 cc) is about 11.5 MPa. In most cases, $P_G$ rose very steeply, in the order of hundreds of MPa per msec. These rates may be too high for a practical igniter. Overshoots in the pressure values above the 11.5 MPa level indicated nonequilibrium processes of localized concentrated combustion in the chamber. These steep pressure rises were preceded by runaway pressure rises in the LGP reservoir.

The first case of group C/Y, photographed at 5000 frames per second with a Photec camera and using back lighting, indicated a liquid ejection velocity higher than 300 m/sec. The pressure measurements and the photography validated the operation principles of the igniter.

The viability of regenerative electrical igniters based on liquid gun propellant had been proven. The igniters' design needs much refinement in order to become truly practical. The igniters should be designed to operate at peak gun pressures. Although successful operation was demonstrated with 400 and 500 volts electrode voltage, higher voltages than that used are recommended for increased effectiveness.

Inasmuch as the present invention is subject to many variations, modifications and charges in detail, it is intended that all matter contained in the forgoing description or shown in the accompanying drawings shall be interpreted as illustrative and not in a limiting sense.

I claim:

1. An electrical igniter comprising:

body means;

means defining an interior cavity in said body means for receiving a liquid charge to be ignited;

inlet port means in said body means communicating with said interior cavity;

outlet port means in said body means communicating with said interior cavity;

means for closing said inlet port means;

electrode means at said interior cavity for igniting a charge therein; and valve means for opening and closing said interior cavity to said outlet port means;

said valve means including an outlet valve positioned proximate said electrode means for releasing hot combustible gas generated during combustion;

said valve means further including means for releasing a discrete discharge of the liquid charge to interact with the releasing hot combustible gas such that the discharging liquid charge is combusted by the hot combustible gas.

2. The invention of claim 1 including means responsive to a threshold pressure in the interior cavity generated during combustion for retracting said valve means to thereby release the combustible gas and the liquid charge.

3. The invention of claim 1 wherein said electrode means includes a plurality of electrodes extending into said interior cavity and a conductive contract ring disposed about said body means and in electrical contact with said electrodes for applying an ignition voltage thereto.

4. The invention of claim 1 wherein the valve means is a cylindrical stem valve disposed for axial movement in said interior cavity and having a hollow core axially portion therein, and including port means extending through said stem valve to intercomment said interior cavity with said hollow core portion.

5. The invention of claim 4 wherein said valve faces have conical configurations which are concentrically arrayed.

6. The invention of claim 5 including means responsive to a threshold pressure in the interior cavity generated during combustion for retracting said stem valve to thereby release the combustible gas and the liquid charge.

* * * * *